US007024837B2

(12) United States Patent
Takebe et al.

(10) Patent No.: US 7,024,837 B2
(45) Date of Patent: Apr. 11, 2006

(54) CAPPING METHOD AND CAPPING APPARATUS

(75) Inventors: Minoru Takebe, Ishikawa-Ken (JP); Mitsuru Kasai, Ishikawa-Ken (JP); Kenichiro Yoshida, Ishikawa-Ken (JP)

(73) Assignee: Shibuya Kogyo Co., Ltd., Kanazawa (JP)

( * ) Notice: Subject to any disclaimer, the term of this patent is extended or adjusted under 35 U.S.C. 154(b) by 420 days.

(21) Appl. No.: 10/099,321

(22) Filed: Mar. 15, 2002

(65) Prior Publication Data

US 2002/0148205 A1 Oct. 17, 2002

(30) Foreign Application Priority Data

Apr. 13, 2001 (JP) ..... 2001-114945

(51) Int. Cl.
*B65B 7/28* (2006.01)
*B67B 3/26* (2006.01)

(52) U.S. Cl. ..... 53/490; 53/75; 53/317

(58) Field of Classification Search ..... 53/490, 53/331.5, 317, 75, 485, 484, 318, 334
See application file for complete search history.

(56) References Cited

U.S. PATENT DOCUMENTS 4,535,583 A * 8/1985 Tanaka et al. ..... 53/75
4,558,554 A * 12/1985 Herbert ..... 53/331.5
4,616,466 A * 10/1986 Tanaka et al. ..... 53/75
5,321,935 A * 6/1994 Spatz et al. ..... 53/490
5,400,564 A * 3/1995 Humphries et al. ..... 53/75
5,983,596 A * 11/1999 Corniani et al. ..... 53/317
6,058,760 A * 5/2000 Van Heyningen ..... 73/1.79
6,105,343 A * 8/2000 Grove et al. ..... 53/490
6,410,909 B1 * 6/2002 Rudolph et al. ..... 250/231.13
6,525,498 B1 * 2/2003 Zalkin et al. ..... 318/432

FOREIGN PATENT DOCUMENTS

DE 198 19 664 * 4/1999
JP 5-229593 9/1993

* cited by examiner

*Primary Examiner*—Stephen F. Gerrity
*Assistant Examiner*—Paul Durand
(74) *Attorney, Agent, or Firm*—Flynn, Thiel, Boutell & Tanis, P.C.

(57) ABSTRACT

A screw capper 1 includes a capping head 6 which grips a cap 5, a servo motor 7 which rotates the capping head, a voltmeter 10 which measures the torque of the capping head, an encoder 11 which detects the rotational angle of the capping head, and a control device 8 which controls the servo motor. In the screw capper, whether rotational fastening is acceptable is to be determined during the rotational fastening, the measured value of the encoder is measured from a predetermined measurement starting point until a rotational fastening completion point, and if the measured rotational angle is in the range of an acceptable decision angle which is set in advance, it is determined that the rotational fastening has been acceptably performed, whereas if the measured rotational angle is not in the range of the acceptable decision angle, it is determined that the rotational fastening is unacceptable.

In the screw capper, defective rotational fastening can be detected, and reductions in costs can be realized compared to a case where a device for detecting such defective rotational fastening is separately provided.

1 Claim, 3 Drawing Sheets

CAPPING METHOD AND CAPPING APPARATUS

FIELD OF THE INVENTION

The present invention relates to a capping method of and a capper for screwing a cap to a container.

DESCRIPTION OF THE PRIOR ART

A capper has heretofore been known which includes a capping head which retains a cap, driving means which rotates this capping head in forward and reverse directions, torque measuring means which measures fastening torque which acts on the cap, and a control device which controls the driving means. The capper monitors the measured value of the torque and completes screwing when the measured value reaches a predetermined rotational fastening torque value. After the screwing has been completed, the capper unfastens the cap to determine a cap-opening torque value, and corrects a fastening torque value to be outputted to the driving means, on the basis of the cap-opening torque value (Japanese Patent Laid-Open No. 229593/1993)

In Japanese Patent Laid-Open No. 229593/1993, the cap-opening torque value is compared with an acceptance decision torque value which is set in advance, and when the difference between these values exceeds an allowable range, a fastening torque value to be transmitted to the driving means is corrected so that the fastening torque value is managed with high precision.

In the case where the screw thread portion of a cap or the screw thread portion of a container is defectively formed, for example, the screw thread portion is damaged, packing inside the cap may fail to come into abutment with the mouth portion of the container, so that a predetermined fastening completion torque value may be obtained. However, the art of the above-cited specification has the problem of being unable to detect a case corresponding to such a defective rotational fastening.

As a method of solving such a problem, it can be considered to adopt a construction in which a detecting device for detecting defective rotational fastening is separately provided on the downstream of the capper. This construction, however, incurs an increase in cost.

SUMMARY OF THE INVENTION

In view of the above-described problems, the first invention provides a capping method which uses a capping head which retains a cap, and a motor which rotates the capping head, the capping method causing the cap retained by the capping head to rotate in a cap-closing direction and screwing the cap to a container with a predetermined cap-closing torque. The capping method includes the steps of measuring a rotational angle of the capping head from a predetermined measurement starting point until a completion of rotational fastening, and determining whether the rotational fastening is acceptable, according to whether the rotational angle is within a range of an acceptance decision angle which is set in advance.

The second invention provides a capper which includes a capping head which grips a cap, a motor which rotates the capping head, a control device which controls the motor to rotate the cap in a cap-closing direction and rotationally fasten the cap to a container with a predetermined cap-closing torque. In accordance with the invention, the capper provides rotational angle detecting means for measuring a rotational angle of the capping head. The value measured by the rotational angle detecting means is inputted to the control device, and the control device finds the rotational angle by measuring the value measured by the rotational angle detecting means, from a predetermined measurement starting point until a completion of rotational fastening, and determines whether the rotational fastening is acceptable, according to whether the rotational angle is within a range of an acceptance decision angle which is set in advance.

According to the invention, if the cap fails to be rotationally fastened so that its packing comes into abutment with the mouth portion of a container, owing to the defective formation of a screw thread portion of the cap or the defective formation of a screw thread portion of the container, that failure can be measured as a decrease in the rotational angle of the cap.

Accordingly, by determining whether an angle by which the cap actually rotates is within the range of the acceptable angle, a decision as to whether rotational fastening is acceptable can be accurately made in the capper. In addition, since the rotational angle detecting means is merely provided in the capper, costs can be reduced compared to a case where a device for detecting defective rotational fastening is separately provided.

Further objects, features and advantages of the invention will become apparent from the following detailed description of an embodiment of the invention with reference to the accompanying drawings.

DETAILED DESCRIPTION OF THE EMBODIMENTS

Figure 1:
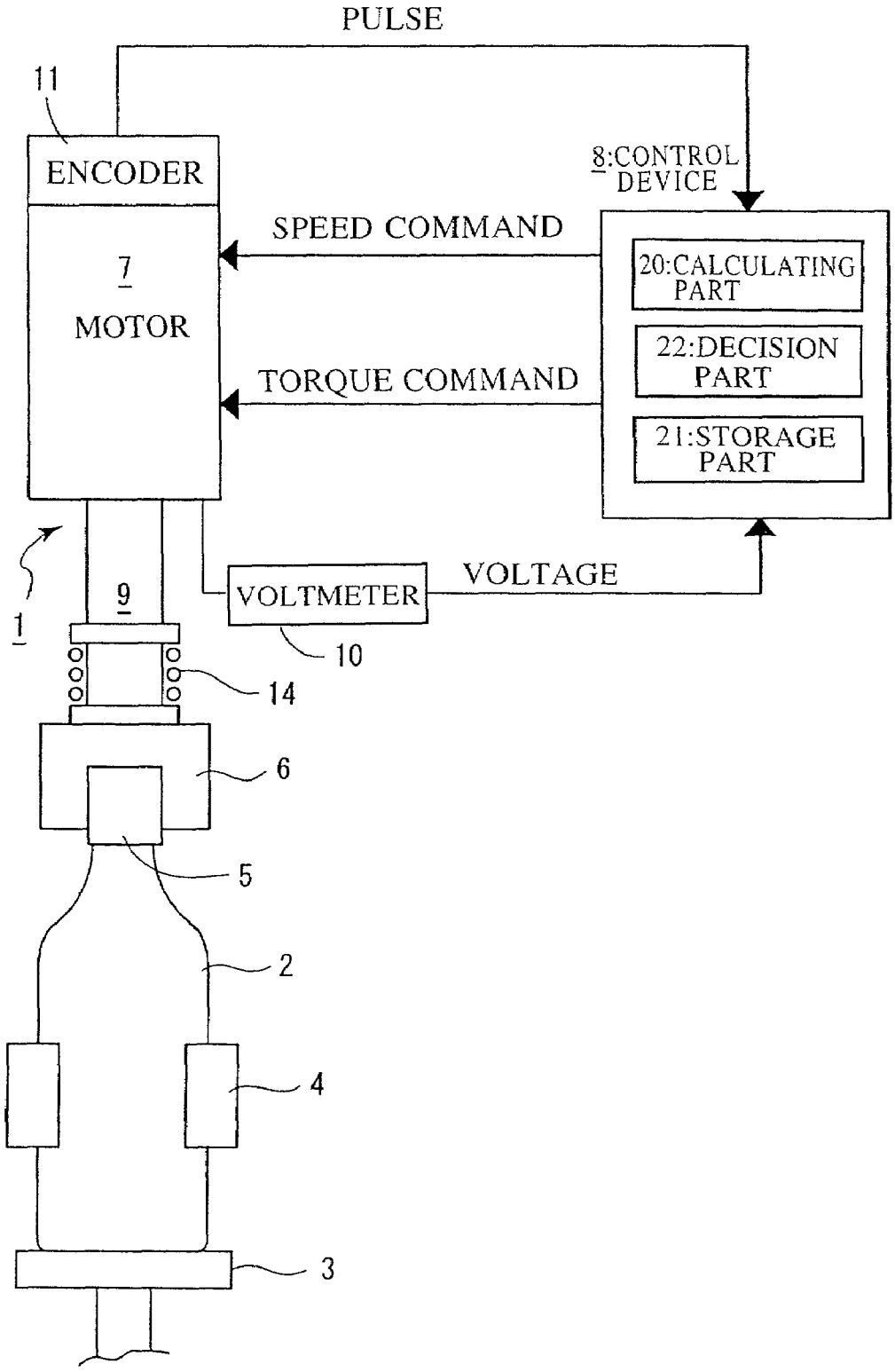
FIG. 1 is a schematic plan view showing an embodiment of the invention.

The invention will be described below with reference to its embodiment shown in the accompanying drawings. In FIG. 1, reference numeral 1 denotes a rotary type of screw capper to which the invention is applied.

The rotary type screw capper 1 includes carriages 3 (one of which is shown) which are respectively provided at circumferentially equally spaced positions around a rotator (not shown) and on each of which a container 2 is to be placed, grippers 4 (one of which is shown) each of which grips the body portion of the container 2 mounted on the carriages 3, capping heads 6 (one of which is shown) each of which is provided at a position over the carriage 3 to rotationally fasten a cap 5 to the mouth portion of the container 2 gripped by the gripper 4, and a well-known type of lifting cam (not shown) which serves as lifting means for lifting the capping head 6. These capping heads 6 are respectively liftably connected to servo motors 7 via spline shafts 9, and are capable of being rotated in a horizontal plane.

The operation of these servo motors 7 is controlled by a control device 8 which exercises general control over the entire screw capper 1. When torque commands and speed commands are transferred from the control device 8 to the servo motors 7, the servo motors 7 are rotationally driven by the torque commands and the speed commands to rotate the respective capping heads 6.

The above-described construction does not differ from that of the rotary screw capper of the type which has heretofore been known.

In the present embodiment, each of the servo motors 7 is provided with a voltmeter 10 which serves as torque detecting means for detecting its voltage and an encoder 11 which serves as rotational angle detecting means for detecting pulses, and the voltage signal of the voltmeter 10 and the pulse signal of the encoder 11 are inputted to the control device 8 and, on the basis of measured torque T and a rotational angle A obtained during the rotational fastening of the cap 5, the control device 8 makes a decision as to whether the rotational fastening is acceptable, a detection of a defectively formed cap and a defectively formed container, or a detection of a cap having no packing. The control device 8 includes a calculating part 20 which computes the torque T from the input voltage signal and the rotational angle A from the input pulse signal, and a decision part 22 which makes a decision as to whether the rotational fastening is acceptable, by comparing the torque T and the rotational angle A inputted from the calculating part 20 with an acceptance decision torque value and an acceptance decision angle stored in a storage part 21, respectively.

Figure 2:
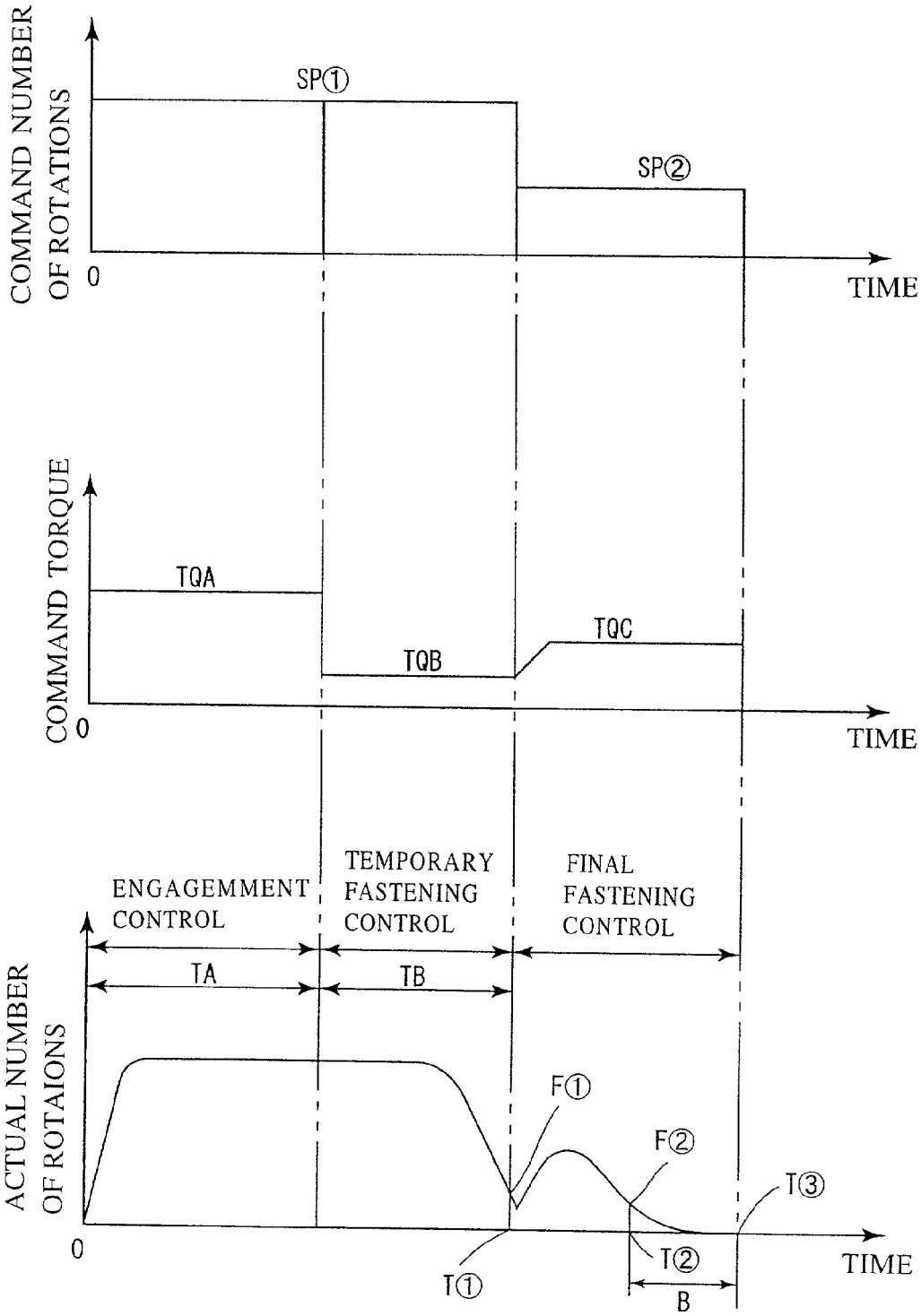
FIG. 2 is a diagram showing control of a control device 8.

The decision as to whether the rotational fastening is acceptable and the detection of a defectively formed cap and a defectively formed container or a cap having no packing will be described in detail with reference to the diagram shown in FIG. 2.

When the control device 8 recognizes that the capping head 6 has reached a predetermined rotational fastening starting position, on the basis of a signal from a rotary encoder which measures the rotational position of the rotator, the control device 8 first outputs a command based on engagement control to the servo motor 7.

In this engagement control, during the start of engagement of the cap 5 with the container 2, even if the cap 5 is brought into anomalous engagement in an inclined state which is called "cooked cap", the control device 8 drives the servo motor 7 with a high torque command TQA so that the cap 5 can be forcedly brought into engagement with the container 2, and also drives the servo motor 7 with a high speed command SP(1) so that the time period of rotational fastening can be reduced. Subsequently, this engagement control is continued until the cap 5 makes one rotation (360 degrees), because the positional relationship between a leading end of the screw thread portion of the container 2 and a leading end of the screw thread portion of the cap 5 is not uniform.

Incidentally, this engagement control is not necessarily needed, and may also be omitted as the case may be.

Then, while the capping head 6 is making one rotation, the screw thread portion of the cap 5 comes into engagement with the screw thread portion of the container 2, and when the control device 8 recognizes that the capping head 6 has made one rotation, on the basis of the number of pulses of the encoder 11 or the elapse of time, the control device 8 proceeds from the engagement control to temporary fastening control. In this temporary fastening control, the control device 8 drives the servo motor 7 with a low torque command TQB which indicates a smaller torque than does the high torque command TQA for the engagement control, but continues to drive the servo motor 7 with the high speed command SP(1). During this time, the capping head 6 is made to rotate in a state substantially close to an idle state until the cap 5 is rotated by the required number of times, so that the torque of the capping head 6 is maintained in an approximately zero state during this time.

Then, when the capping head 6 is rotated by the required number of times and packing (not shown) inside the cap 5 comes into abutment with the upper end face of the mouth portion of the container 2 and is brought into a compressed state, the resistance applied from the container 2 increases and the rotational speed of the capping head 6 decreases.

In other words, in the embodiment, by setting the torque value of the above-described torque command TQB to a small value, the rotational speed of the capping head 6 decreases with an increase in the resistance applied from the container 2.

Then, when the rotational speed of the capping head 6 becomes lower than a temporary fastening completion speed F(1) which is set in advance, the control device 8 recognizes that the cap 5 has reached a temporary fastening completion state. When the capping head 6 becomes lower than the temporary fastening completion speed F(1) in this manner, the control device 8 sets this point of time as a measurement starting point T(1) and starts to measure the rotational angle A of the capping head 6 on the basis of the pulse signals of the encoder 11, and in the meantime outputs a command based on final fastening control. In this final fastening control, the control device 8 drives the servo motor 7 with an intermediate torque command TQC which indicates a larger torque than does the low torque command TQB and a smaller torque than does the high torque command TQA, and also drives the servo motor 7 with a low speed command SP(2) which indicates a lower rotational speed than does the high speed command SP(1).

As the capping head 6 is made to rotate by the required number of times in this manner and the compressive deformation of the packing inside the cap 5 proceeds to increase the resistance applied from the container 2, the rotational speed of the capping head 6 gradually decreases and becomes lower than a final fastening completion speed F(2). The control device 8 sets this point of time as a measurement completion point T(2) and completes the measurement of the rotational angle A. Then, after this measurement completion point T(2), the control device 8 further drives the servo motor 7 with the intermediate torque command TQC and the low speed command SP(2) for only a predetermined time period B which is set in advance, and completes the final fastening.

Incidentally, the time point of the completion of rotational fastening is not limited to the time at which the rotation of the capping head 6 actually comes to a stop and rotational fastening is completed, and may also be a time point such as the time point T(2) at which it can be determined that the rotational speed of the capping head 6 has become lower than a predetermined rotational speed and rotational fastening has been substantially completed, or a time point T(3) at which rotational fastening is actually completed and the capping head 6 comes to a stop.

Then, the control device 8 which has measured the rotational angle A compares the rotational angle A with an acceptance decision angle which is obtained by experiment or the like and stored in the storage part 21 in advance, by means of the decision part 22, and if the rotational angle A is within the range of the acceptance decision angle, the control device 8 determines that optimum rotational fastening has been performed. On the other hand, if the rotational angle A is smaller than the acceptance decision angle, the control device 8 determines that defective rotational fastening due to a defectively formed cap or a defectively formed container has occurred, whereas if the rotational angle A is larger than the acceptance decision angle, the control device 8 determines that defective rotational fastening due to a cap having no packing has occurred.

Incidentally, if it is determined that the cap 5 is defectively rotationally fastened to the container 2, the container 2 is eliminated from a line by a rejecting device which is not shown, or an alarm is issued to urge an operator to eliminate the defective product.

As can be understood from the above description, in accordance with the embodiment, defective rotational fastening can be detected in the screw capper 1, and since whether rotational fastening is acceptable is merely determined on the basis of the pulse signal of the encoder 11, reductions in costs can be realized compared to a case where a defective rotational fastening detecting device is separately provided.

Incidentally, in the above-described embodiment, the time point at which the rotational speed of the capping head 6 becomes lower than the temporary fastening completion speed F(1) which is a criterion for determining whether the process is to proceed to the final fastening is set as the measurement starting point T(1), but the measurement starting point T(1) is not limited to such a time point. For example, the time point at which the rotation of the capping head 6 comes to a stop may be set as the measurement starting point T(1), or the criterion speed for starting measurement may be set to a speed higher than the temporary fastening completion speed F(1) so that measurement is started before the process proceeds to the final fastening control.

Figure 3:
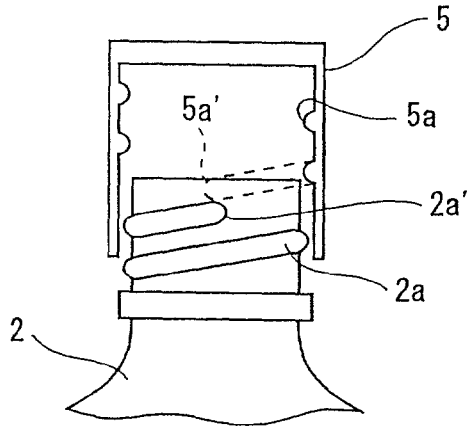
FIG. 3 is a view showing a state in which to detect an engagement starting point at which to start engagement between a screw thread portion 5*a* of a cap 5 and a screw thread portion 2*a* of a container 2.

In addition, in the above-described embodiment, the measurement starting point T(1) is set as the time at which the process proceeds from the temporary fastening to the final fastening, but an engagement starting position at which to start engagement between the cap 5 and the container 2 may be detected to set this engagement starting position as the measurement starting point T(1). A method of detecting this engagement includes the steps of detecting a position at which, as shown in FIG. 3, a bottom end portion 5*a*' of a screw thread portion 5*a* of the cap 5 (the lower leading end of the screw thread portion 5*a*) comes into contact with a top end portion 2*a*' of a screw thread portion 2*a* of the container 2 (the upper leading end of the screw thread portion 2*a*), on the basis of a variation in the value of the output torque of the servo motor 7 detected by the voltmeter 10 during the rotation of the servo motor 7, and setting the detected position as the engagement starting position. In the case where the engagement starting position is to be detected, software need only be added to the control device 8 and the construction of the screw capper 1 may be unchanged.

Figure 4:
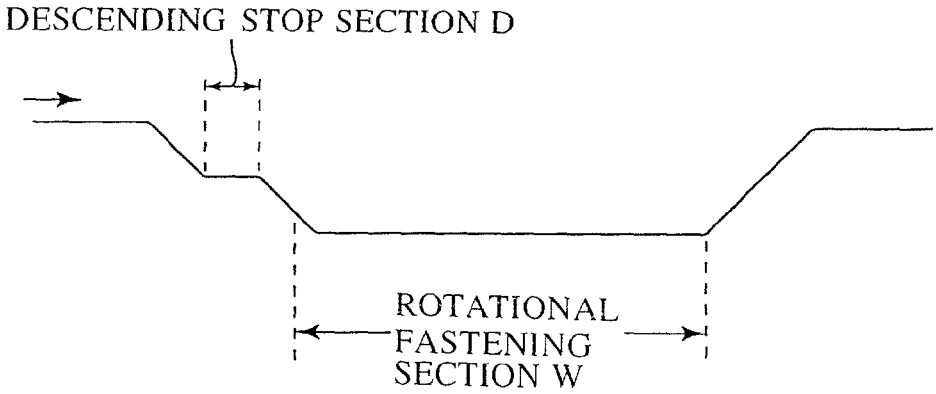
FIG. 4 is a view showing the relationship between the lifting and movement of a capping head 6.

Specifically, as shown on the left-hand side of FIG. 4, a descending stop section D in which the capping head 6 stops descending (the capping head 6 travels at the same height) is formed on the cam surface of the lifting cam which lifts the capping head 6. The descending stop section D is set to a section which is halfway in the process of descending the capping head 6 to a rotational fastening height and is between the moment when the cap 5 is placed on the container 2 and the moment when the female thread 5*a* of the cap 5 is urged against the male thread 2*a* of the container 2 by a spring 14 resiliently fitted between the capping head 6 and the spline shaft 9.

Incidentally, since the urging of the cap 5 by the capping head 6 is started immediately before the lifting cam reaches its lowermost point, FIG. 4 shows the starting point of a rotational fastening section W before the lowermost point.

Then, when the capping head 6 is positioned in the descending stop section D, the height of the cap 5 retained by the capping head 6 is set so that the lowermost end of the bottom end portion 5*a*' of the female thread 5*a* of the cap 5 and the uppermost end of the top end portion 2*a*' of the male thread 2*a* of the container 2 are vertically disposed at approximately the same height that enables abutment between the lowermost end of the bottom end portion 5*a*' and the uppermost end of the top end portion 2*a*' (at the height shown in FIG. 3). When the cap 5 is rotated at this height, the bottom end portion 5*a*' of the female thread 5*a* and the top end portion 2*a*' of the male thread 2*a* of the container 2 are necessarily brought into abutment with each other during the process of rotation of the cap 5. During this time, a load which works in the rotational direction occurs in the cap 5.

Then, in the present embodiment, when the capping head 6 stops descending in the descending stop section D, the control device 8, while detecting through the voltmeter 10 torque which acts on the cap 5, causes the servo motor 7 to make one rotation in the reverse or forward direction, thereby causing the cap 5 retained by the capping head 6 to make one rotation in the reverse or forward direction.

Figure 5:
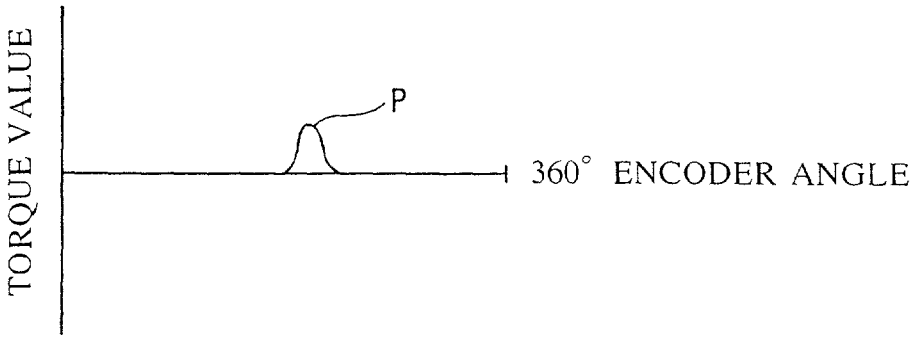
FIG. 5 is a view showing the relationship between the detected torque value of a voltmeter 10 and the rotational angle (rotational speed) of an encoder 11.

When the cap 5 is caused to make one rotation in this manner, the bottom end portion 5*a*' of the female thread 5*a* of the cap 5 and the top end portion 2*a*' of the male thread 2*a* of the container 2 come into abutment with each other once during the rotational process of the cap 5. At the time of this abutment, a maximum output torque P (a load working in the rotational direction) during the process of causing the cap 5 to make one rotation is measured by the voltmeter 10, and when the measured result is inputted to the control device 8, the control device 8 recognizes the rotational angular position of the servo motor 7 at that time by the encoder 11. FIG. 5 shows the relationship between the rotational angular position of the servo motor 7 (the rotational angular position of the cap 5 and the capping head 6) detected by the encoder 11 and the output torque detected by the voltmeter 10 when the servo motor 7 is caused to make one rotation in the direction in which the cap 5 is rotationally fastened. When the bottom end portion 5*a*' of the female thread 5*a* of the cap 5 and the top end portion 2*a*' of the male thread 2*a* of the container 2 come into abutment with each other, the output torque abruptly increases as shown by a hill-like shape in FIG. 5. That is, this position P becomes the engagement starting position.

Incidentally, the method of detecting the engagement starting position is not limited to the above-described method of detecting the engagement starting position on the basis of a variation in the detected value of the output torque. For example, as disclosed in Japanese Patent Publication No. 86034/1995, a position at which when a cap is rotated in the reverse direction, the engagement between the screw thread portions of both the cap and a container is released and a position in which the cap falls may be detected as the engagement starting position.

In addition, in the embodiment, torque during rotational fastening is detected by using the voltmeter 10, but an ammeter or a load cell may also be used. In addition, actually outputted torque may of course also be directly detected. Furthermore, rotational fastening may be effected by command torque and the rotational speed of the capping head 6 without providing torque detecting means such as the voltmeter 10.

Furthermore, although in the embodiment the invention is applied to the rotary type screw capper 1, the invention is not limited to this type of screw capper, and may also be applied to a line type screw capper.

Although the embodiment of the invention has been specifically described above, the invention is not limited to only the embodiment and can of course be modified in various manners without departing from the scope and spirit of the invention.

What is claimed is:

1. A capping method for a capping head for retaining a cap and a motor for rotating the capping head and in which the cap retained by the capping head is rotated in a cap-closing direction and rotationally fastens the cap to a container with a predetermined cap-closing torque, characterized in that the capping method comprises the steps of:

fastening the cap temporarily to the container by rotationally fastening the cap to the container with a first predetermined torque;

fastening the cap finally to the container by rotationally fastening the cap to the container with a second predetermined torque which is different from the first predetermined torque;

setting a point of transition from the temporary fastening step to the final fastening step as a measurement starting point of a rotational angle;

measuring the rotational angle of the capping head from the measurement starting point until the completion of the final fastening step; and determining whether the rotational fastening is acceptable according to whether the rotational angle is within a predetermined range, wherein the cap is rotationally fastened with a lower torque in the temporary fastening step than in the final fastening step and the measurement point is at a point in time at which the rotational speed of the capping head becomes lower than a temporary fastening completion speed.

* * * * *